United States Patent [19]

Wyatt

[11] 4,441,460

[45] Apr. 10, 1984

[54] APPARATUS FOR HEATING AND UTILIZING FLUIDS

[75] Inventor: William G. Wyatt, Arlington, Tex.

[73] Assignee: Vapor Energy, Inc., Arlington, Tex.

[21] Appl. No.: 261,702

[22] Filed: May 8, 1981

[51] Int. Cl.[3] ..... F22B 1/02

[52] U.S. Cl. ..... 122/31 R; 122/412; 126/360 A; 166/261; 431/210

[58] Field of Search ..... 122/31 R, 31 A, 412; 126/360 A; 166/261, 275; 431/210

[56] References Cited

U.S. PATENT DOCUMENTS

| | | | |
|---|---|---|---|
| 3,692,017 | 9/1972 | Glachant et al. | 126/360 A |
| 3,717,139 | 2/1973 | Guillet et al. | 126/360 A |
| 3,933,600 | 1/1976 | Dodge | 126/360 A X |
| 4,018,216 | 4/1977 | Thurley | 122/31 A X |

*Primary Examiner*—Edward G. Favors

*Attorney, Agent, or Firm*—Thomas L. Cantrell; Joseph H. Schley; Stanley R. Moore

[57] ABSTRACT

Disclosed are methods and apparatus for heating and utilizing fluids by the use of vapor generators of the kind in which a flowing fuel/air mixture is combusted in the presence of a stream of feed water to produce a stream of steam and non-condensibles, preferably at low pressure. This hot stream is then heat exchanged with a stream of the fluid desired to be heated and utilized, to heat it to the level desired for use, including partly or completely vaporizing it, if the use so requires. The fluid may be divided into two or more streams during the heat exchange, with different amounts of heat delivered into each stream. Preferably, the heat exchange is so conducted as to condense the steam from the stream of steam and non-condensibles, and the condensate so formed is selectively recycled to the vapor generator as feed water. Also, disclosed are means for utilizing the stream of heated fluid, including high pressure hot water flooding of petroleum reservoirs, vaporization of LPG or propane for combustion, line heating of natural gas pipelines to avoid condensation therein, and line heating of heavy oil pipelines to promote flow.

7 Claims, 5 Drawing Figures

FUEL
AIR
FEEDWATER
NON-CONDENSIBLES
WARM WATER
INJECTION WATER
ADDITIVES
10
11
12
13
14
15
16
17
18
19
20
21
22
23
25
26
27
28
29
30
31
32
33
V
P
V REL

APPARATUS FOR HEATING AND UTILIZING FLUIDS

BACKGROUND OF THE INVENTION

Boilers are the traditional means for supplying energy in many applications despite the fact that they may not be easily matchable to the temperature, pressure, and flow requirements of a particular application. One difficulty in this regard flows from the fact that in a boiler these parameters are not independent, and changes in heat throughput at constant flow, for example, are accompanied by changes in temperature, pressure, or both. In addition, boilers are expensive and complex, and require extensive maintenance. In most instances the boiler feed water requires chemical treatment to retard corrosive wear of the boiler.

Vapor generators of the kind shown in U.S. Pat. No. 4,211,071 and in my copending U.S. patent application Ser. No. 37,029, filed May 8, 1979, represent alternate means for supplying energy, and offer some material advantages over boilers in the way of equipment simplification and reduced maintenance requirements. However, the product stream from a vapor generator contains a relatively high proportion of non-condensibles, which is undesirable in many applications, and in the case of older forms of vapor generators, the non-condensibles include pollutants such as carbon monoxide and unburned hydrocarbons. In addition, when a high pressure stream is required, capital and operating costs for the air compressor stage of a vapor generator are high.

Some energy consuming applications require a liquid product stream which is at a fairly high temperature and a very high pressure. Hot water flooding systems for recoverying oil from reservoirs are one example. Other examples include heating lines for natural gas and petroleum pipelines. On the other hand, other energy consuming applications require a vaporized product from an initially liquefied source, such as propane, while still other applications may require two or more streams at different temperature, pressure, and flow conditions.

SUMMARY OF THE INVENTION

In accordance with the invention, the foregoing problems are addressed and overcome, by methods and apparatus involving the generation of a low pressure stream of steam and non-condensibles by combusting a stream of mixed fuel and air in the presence of a stream of feedwater, and the exchange of heat between that product stream and one or more streams of the fluid of interest to bring it (or them) to the particular temperature, pressure, and flow conditions required by or desirable for, the use to which the fluid is put. To maximize efficiency, it is preferred that the heat exchange be so conducted that the steam is condensed from the product stream. It is also preferred that the condensate be separated from the non-condensibles and selectively recycled as feedwater to the generator stage.

When the fluid of interest is to be brought to a high pressure for use, whether vaporized in the heat exchange step or not, it may be pressurized by being pumped upon as a cool liquid upstream of the heat exchange step. Such pressurization of fluid of interest need not be accompanied by a parallel increase in the pressure of the stream of steam and non-condensibles. As a consequence of these features of the invention, a highly pressurized fluid of interest may be produced with relatively low costs (both capital and operating) for pumps and blowers. The pressurizing pump, since it is working on a cool liquid, is relatively small and trouble-free, as compared to a pump working on a hot liquid, or a vapor. The air blower for the combustion system is also relatively small and low in operating costs since the steam and non-condensibles side of the system is operated at low pressure, notwithstanding the high pressure of the fluid of interest output.

As was mentioned above, it is preferred that the exchange of heat result in condensation of the steam in the product stream of the vaporizer. Such an operating condition tends to maximize efficiency by utilizing the heat of vaporization stored in the product stream as well as its sensible heat in both the vapor and liquid stages. The condensate is a very pure warm water which is quite suitable as a partial or total source of feedwater for the vapor generator, thus further enhancing efficiency. Condensate which is not so used may be employed as an auxilliary source of warm water for general utility purposes.

DESCRIPTION OF THE PREFERRED EMBODIMENTS

Figure 1:
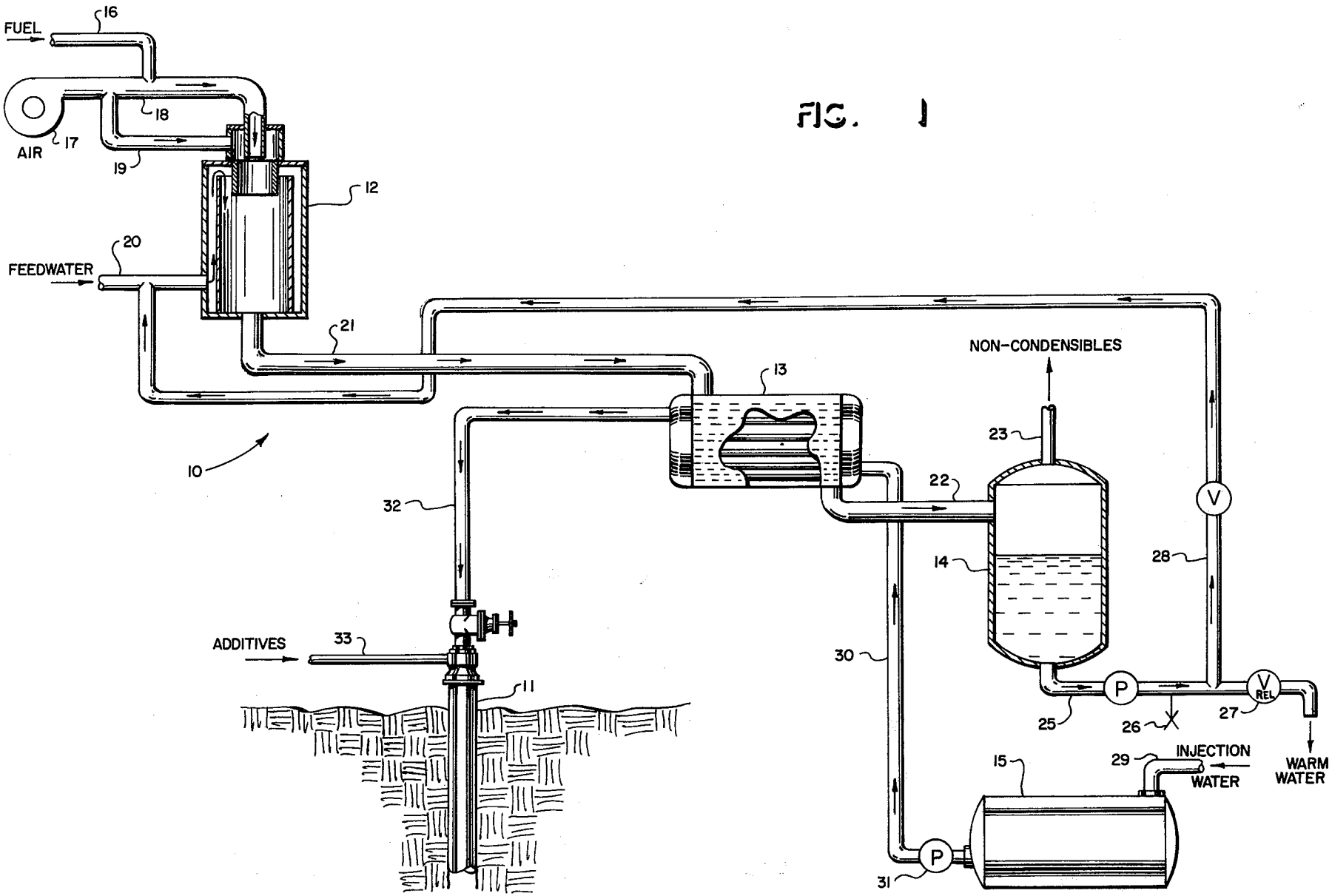
FIG. 1 is a diagrammatic side elevational view, partly in section, of an embodiment of the invention as applied to a system for heating water for injection into a petroleum formation.

Attention is directed first to FIG. 1, where a system of the invention is designated generally as 10, and where it is shown set up to supply hot high pressure water for injection into an oilwell 11. The system includes a vapor generator 12, a heat exchanger 13, a separator 14, and an injection water supply tank 15, together with lines connecting these elements in accordance with the invention, and with pumps and valves at selected locations in said lines.

As is explained in more detail in my above mentioned U.S. Pat. No. 4,211,071, generator 12 produces a product stream containing steam and hot non-condensibles, primarily nitrogen and carbon dioxide, by the combustion within the generator of fuel with air in the presense of feedwater. Fuel is introduced through line 16, combustion air through blower 17 and lines 18, 19, and feedwater through line 20. The product stream leaves the generator 12 through generator output line 21, which delivers it to the shell side of heat exchanger 13. Typically the product stream is at relatively low pressure, such as 5 psig, and is fairly warm, such as 300° F.

In heat exchanger 13, the product stream gives up heat to the fluid flowing through the tube side of the exchanger. It is preferred that the pressure and flow conditions be such that the steam in the product stream be condensed in the course of its traverse of the shell side of the exchanger. Under preferred conditions, then, the stream leaving exchanger 13 through exchanger output line 2 is a mixture of warm liquid water and warm non-condensibles.

Exchanger output line 22 delivers this mixture to separator 14 where the non-condensibles and the warm water separate, with the non-condensibles leaving the separator at the top through exhaust line 23. The separated water is pumped from the separator through separator output line 25, by a pump therein to leave the system through valves 26 or 27, or to be recycled for use as generator feedwater through recycle line 28, which is connected between lines 25 and 20.

Injection water is introduced into tank 15 through line 29. In many cases it will be preferred that the injection water be "connate water", that is, water originally derived from the formation being treated and thus having the same ionic content as formation water. Connate water is thus in equilibrium with the minerals of the formation and when returned to contact with them does not cause swelling or other untoward effects. The injection water may also be artificially compounded connate water, or, in the case of formations which are not sensitive to the the ionic content of the injected water, from surface water. In the latter two instances, some of the water may comprise condensate from line 25, which has the advantage that its heat is delivered to the formation being treated.

Injection water is pumped from tank 15 to the tube side of exchanger 13 through line 30 by pump 31, which develops the pressure desired for delivery into the formation. In its passage through exchanger 13, the injection water picks up heat and temperature from the vapor generator product stream. Various additives may be added through line 33. It should be noted that pump 31 works on the injection water while it is cool, which simplifies the pump requirements as compared to a pump working on hot water. Also, the product stream of the vapor generator is at a low pressure, while the injection water is injected into the well at high pressure. Furthermore, pump 31 for pressurizing liquid is a smaller item of capital expense than would be a compressor such as 17 capable of bringing an equivalent quantity of combustion air to the same pressure.

FIG. 1 can be taken to illustrate another embodiment of the invention if one regards tank 15 as charged with liquid carbon dioxide rather than water. In such an embodiment the operation is substantially the same as described above, except that a change of state takes place in the carbon dioxide stream flowing through the tube side of the heat exchanger, as it extracts heat from the vapor generator product stream flowing on the shell side. Carbon dioxide, under pressure, and vaporized, is delivered to well 11 through line 32.

Figure 2A:
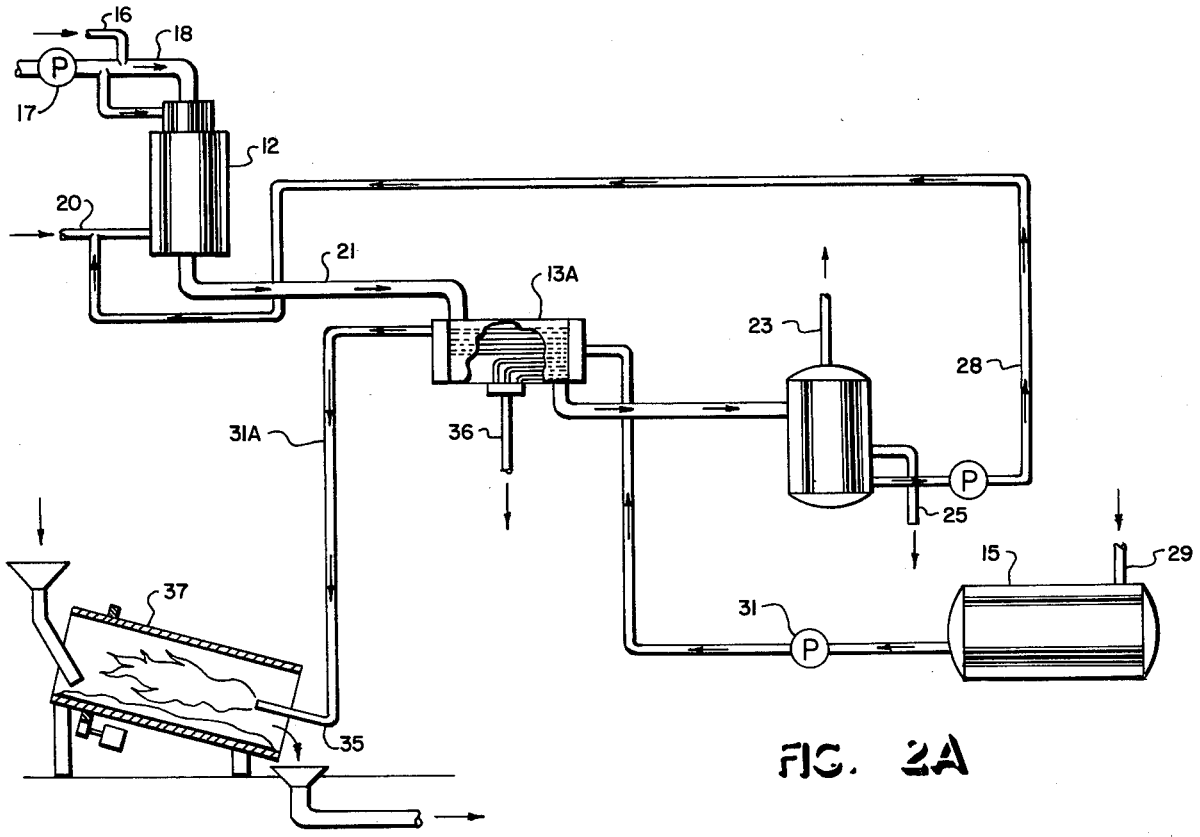
FIG. 2A is a diagrammatic side elevational view, partly in section, of another embodiment of the invention, as applied to a system for vaporizing propane or the like for combustion in a burner.

FIG. 2A shows another embodiment of the invention. Parts which are essentially the same as those shown in FIG. 1 are given the same reference character; those which are modified are given the same number with the addition of the letter "A". In the embodiment of FIG. 2A, tank 15 is charged with liquid propane or another liquified natural gas product, which is to be vaporized prior to delivery to burner 35 in kiln 37. The energy required for vaporization is generated in vapor generator 12 and heat exchanged with the propane in heat exchanger 13A. The vaporized propane leaves the exchanger through line 31A and is delivered to burner 35.

Heat exchanger 13A differs from heat exchanger 13 of FIG. 1 in that its tube side is divided, with some of the tubes issuing into line 31A and the remainder issuing into line 36. While such an arrangement would have limited application when the tube-side working fluid is propane, it is an attractive feature of the invention, because it makes it possible to divide the tube-side working fluid into two or more streams to which differing amounts of heat are added from the shell side product stream from the vapor generator, thus improving flexibility and efficiency.

Figure 2B:
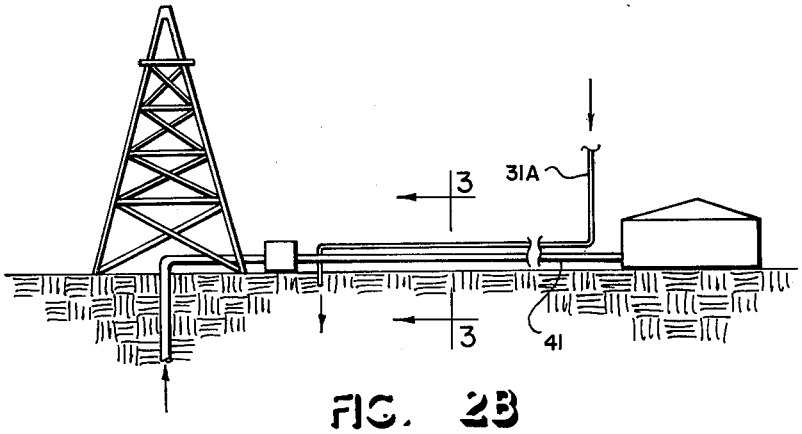
FIG. 2B is a fragmentary side elevational view of a system utilizing the product stream of the invention for heat tracing a pipeline for heavy oil.
Figure 3:
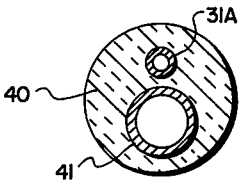
FIG. 3 is an enlarged cross-sectional view taken of the line 3—3 of FIG. 2B.

In FIGS. 2B and 3 there is shown in alternate employment of the high temperature stream produced in line 31A, which in this case is presumed to be steam. By being bound in an insulation package 40 closely adjacent heavy oil line, the steam line 31A delivers heat to the flowing oil in line 41 to reduce its viscosity so it will be pumpable, and at lower cost.

Figure 2C:
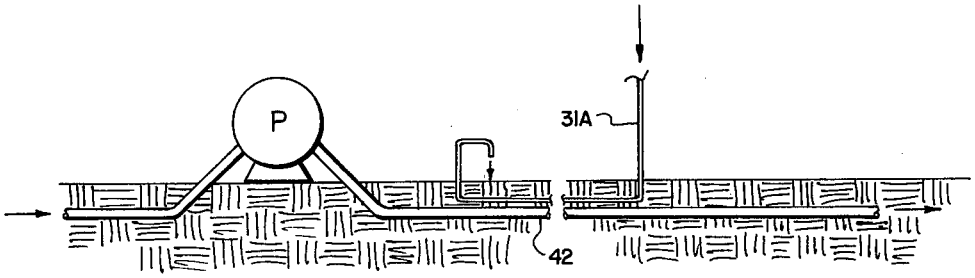
FIG. 2C is a fragmentary side elevational view of a system utilizing the product stream of the invention for heat tracing a pipeline for natural gas to prevent condensation of natural gasoline liquids therein.

In FIG. 2C, still another alternate employment of the high temperature stream produced in line 31A, in this case again assumed to be steam. Steam line 31A traces a gas pipeline 42 to prevent natural gasoline fractions contained in the gas from condensing out of the flowing gas stream.

What is claimed is:

1. Apparatus for providing a hot water flood to a reservoir comprising:

means for generating a low pressure stream of steam and non-condensibles by combusting a flowing fuel/air mixture in the presence of a stream of feedwater;

pump means for delivering a stream of relatively cool water at high pressure from a source thereof;

a heat exchanger for effecting heat exchange between said low pressure stream of steam and non-condensibles and said stream of cool high pressure water to heat the water stream to a desired temperature without substantially reducing the pressure thereon, while condensing at least some of the steam from said stream of steam and non-condensibles; and means for delivering said stream of heated high pressure water from said heat exchanger into the bore of a well communicating with said reservoir.

2. Apparatus in accordance with claim 1 and further comprising means for introducing an additive to said stream of heated high pressure water.

3. Apparatus in accordance with claim 1 and further comprising means for separating said condensed steam from said non-condensibles after their passage through said heat exchanger.

4. Apparatus in accordance with claim 1 and further comprising means for recycling at least some of said condensed steam to said generating means as feedwater therefor.

5. Apparatus for vaporizing an initially liquified fuel in preparation for combustion thereof comprising:

means for delivering a stream of liquified fuel from a source thereof toward a point at which it is to be combusted in vaporized form;

means for generating a low pressure stream of steam and non-condensibles by combusting a flowing fuel/air mixture in the presense of a stream of feedwater; and means for effecting heat exchange between said stream of liquified fuel and said stream of steam and non-condensibles to add heat to said stream of liquified fuel to vaporize it.

6. Apparatus in accordance with claim 5 in which sufficient heat is extracted from said stream of steam and non-condensibles in said heat exchange means to condense the steam therefrom.

7. Apparatus in accordance with claim 6 and further comprising:

means for receiving said stream of condensed steam and non-condensibles from said heat exchange means and separating the condensate from the non-condensibles; and means for selectively recycling at least some of said condensate as feedwater to said generating means.

* * * * *